United States Patent [19]

Anderson

[11] 4,077,068

[45] Mar. 7, 1978

[54] UNDERWATER DIVING MASK

[76] Inventor: Richard E. Anderson, 2102 Oak St., Santa Monica, Calif. 90405

[21] Appl. No.: 713,136

[22] Filed: Aug. 9, 1976

[51] Int. Cl.[2] ..... A61F 9/02

[52] U.S. Cl. ..... 2/428; 2/452; 128/146.7

[58] Field of Search ..... 2/428, 429, 430, 452, 2/9; 128/146.7; 351/123

[56] References Cited

U.S. PATENT DOCUMENTS

| | | | |
|---|---|---|---|
| 1,942,442 | 1/1934 | Motsinger | 2/9 X |
| 3,725,953 | 4/1973 | Johnson et al. | 128/146.7 X |

FOREIGN PATENT DOCUMENTS

| | | | |
|---|---|---|---|
| 1,261,514 | 4/1961 | France | 2/430 |
| 1,052,722 | 9/1953 | France | 2/428 |
| 1,189,800 | 3/1959 | France | 2/430 |

*Primary Examiner*—Werner H. Schroeder
*Assistant Examiner*—Peter Nerbun
*Attorney, Agent, or Firm*—Flam & Flam

[57] ABSTRACT

The diving mask incorporates a clamp operated from the outside for squeezing the diver's nostrils together so that he can then "clear his ears," which is the act of allowing, or gently forcing, air through the restriction of the eustachian tubes to equalize the inner ear pressure to that of the increasing ambient pressure. The elements of the clamp are movable in arcuate paths centered above the nostrils in order to achieve a comfortable closure. The handle ends of the clamp are conveniently accommodated in a flexible enlargement of the mask body. A wide strap has a four point quick attachment to the rear of the mask body. The strap is formed of adjustable looped elastic cord that adjusts comfortably to the diver's conformation while fully stabilizing the mask on the wearer's face.

7 Claims, 8 Drawing Figures

UNDERWATER DIVING MASK

FIELD OF INVENTION

This invention relates to equipment for underwater diving, and particularly to a face mask designed to give maximum comfort or minimum discomfort to the diver.

BACKGROUND OF INVENTION

As a diver descends, substantial ambient pressure changes occur that can cause uncomfortable, sometimes painful, inward pressure on the eardrums. The simplest corrective procedure is to squeeze the nostrils while attempting to exhale through the nose which tends to force ambient pressure through the restriction of the eustachian tubes until inner ear pressure is equalized. With hands outside and nostrils inside the mask, some device is necessary to achieve clamping of the nostrils. Many masks have a lower wall sufficiently flexible as to allow it to be moved to close the nostrils sufficiently for the corrective procedure to take place. Other masks have pockets in the lower wall to allow the nostrils to be pinched between the diver's thumb and forefinger as the wall flexes. David L. Senne in his U.S. Pat. No. 3,027,561 points out that the pockets are not readily accessible because the usual breathing mouthpiece is in the way. Senne suggests the use of nose pincers with operating lever arms located in front of the face mask for ready access and for operation by one hand.

Senne's general approach is believed correct. However, Senne's solution leaves something yet to be desired for two reasons. First, Senne's pincers include two elements that pivot about spaced axes beneath the nostrils. The pincers angle inwardly and have a path of movement divergent from the natural path of nostril movement. Furthermore, the center of the pincers may miss the center of the nostrils so that a comfortable closing is not achieved. Finally, the lever ends are exposed and not neatly concealed.

In order to maximize underwater vision, the mask lens is desirably large. Yet the larger the mask, the more unstable it becomes on the wearer's head. A simple two point strap attachment may not be adequate to stabilize the mask. A four point strap attachment is therefore desirable for stability as well as for comfort.

The primary object of this invention is to provide an improved mask having novel means for proper nostril closure and having novel means for comfortable strap attachment.

SUMMARY OF INVENTION

In order to achieve the foregoing objects, I provide a nostril clamp or nostril pincers comprising a pair of symmetical rods having central offset portions extending through the mask at a region located generally above the tip of the nose. At this location the rods are pivotally mounted so that their inner ends move in arcs intercepting the nostril flaps. A nose piece fitted between a recessed portion of the face plate pivotally mounts the rods. The outer ends of the rods are embedded in a nose-like protuberance of the nose piece. The nostrils of the protuberance are accessible to be pinched. As the diver so pinches, his own nostrils are pinched by the rods. The manipulation is entirely natural, psychologically agreeable and accordingly comfortable.

The inner ends of the rods mount nostril flap engaging pads that are adjustable to conform as nearly as possible to the location of the nostril flaps of the diver.

The face plate of the mask is wide for corresponding large angle vision. A strap attaches to the mask at two places on each side, the places of attachment being fairly widely spaced at the top and bottom of the mask body. The strap itself is made of loosely looped, highly stretchable elastic cord that can be readily attached and adjusted for maximum comfort. A stable mask placement is achieved while the contact pressure is minimized.

BRIEF DESCRIPTION OF THE DRAWINGS

A detailed description of the invention will be made with reference to the accompanying drawings wherein like numerals designate corresponding parts in the several figures.

DETAILED DESCRIPTION OF PREFERRED EMBODIMENT

Figure 1:
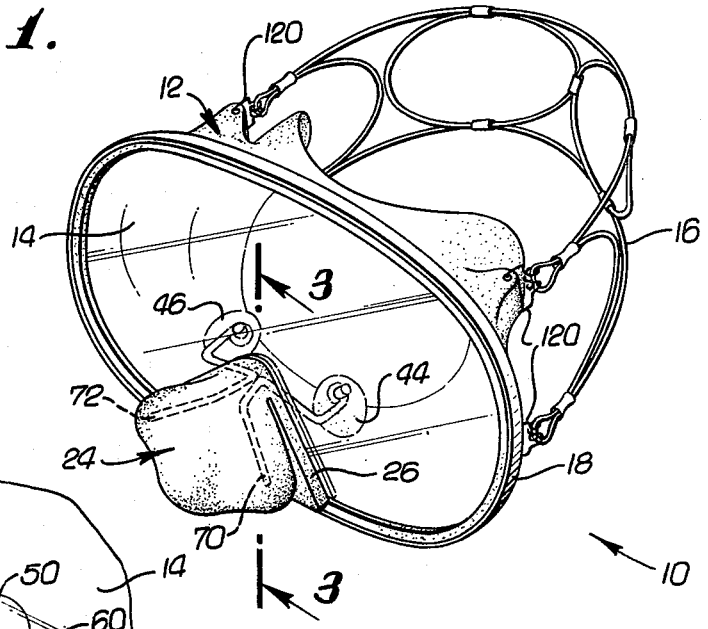
FIG. 1 is a pictorial view of a wide angle underwater diving mask incorporating the present invention.

The following detailed description is of the best presently contemplated modes of carrying out the invention. This description is not to be taken in a limiting sense, but is made merely for purposes of illustrating the general principles of the invention since the scope of the invention is best defined by the appended claims.

The face mask 10 includes three conventional parts, a molded rubber or rubber-like mask body 12, a face plate 14 and a head strap 16. The body has a generally oval frontal rim or bead 18 that provides a continuous channel 20 (FIGS. 2 and 3) for reception of the edges of the face plate 14. In the present example however, the face plate 14 has an inverted V-notch 22 at the region of the diver's nose so that the edge of the face plate separates from the bottom portion of the body channel 20.

A nose piece 24 fits the notch 22. Thus the nose piece includes a generally triangular base part 26. Its lower edge has a rib 28 (FIG. 3) and an adjoining groove 30 to interfit the channel 20 and the outer flange of the rim 18. The two sides of the base 26 provide grooves 32 to receive the corresponding edges of the face plate 14.

While the nose piece base 26 is basically flexible and resilient, it is made relatively stiff for proper support of the face plate by virtue of its being centrally butressed. For this purpose, a generally cylindrical body 34 of a purge valve 36 is fitted in a central aperture 38 of the base 26. The purge valve includes a conventional flap closure 40 that operates as a one way valve as water or air is purged from the mask.

Figure 3:
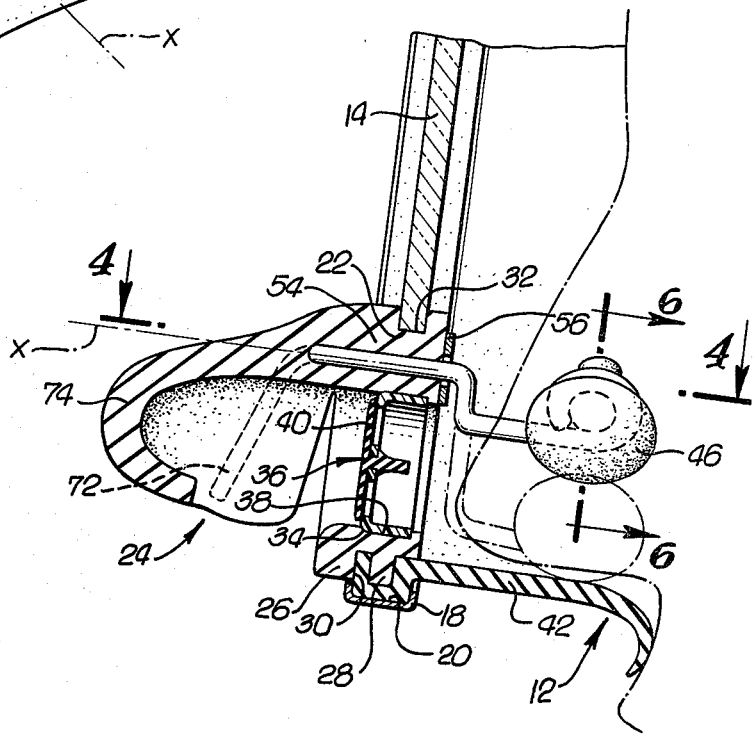
FIG. 3 is a further enlarged fragmentary vertical sectional view taken along a plane corresponding to line 3—3 of FIG. 1.
Figure 4:
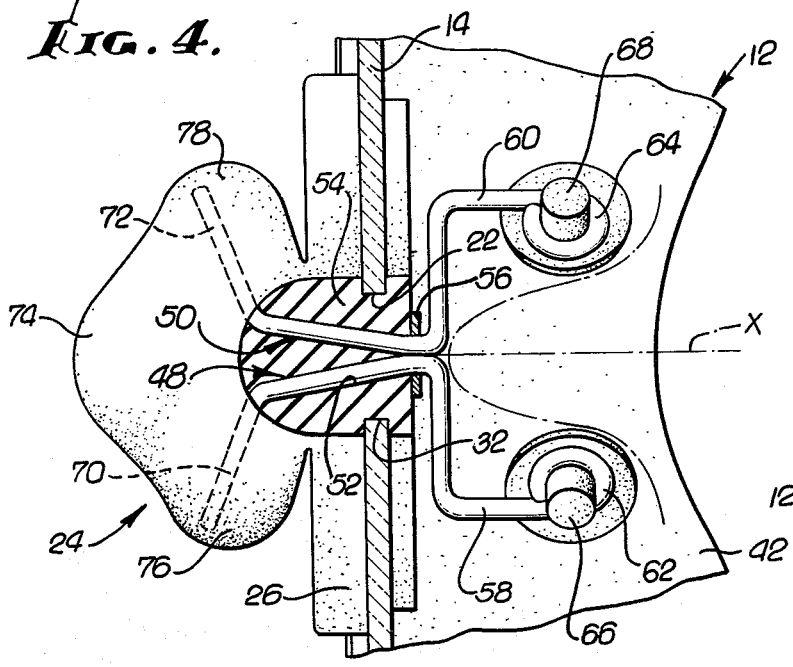
FIG. 4 is a fragmentary sectional view taken along a plane corresponding to line 4—4 of FIG. 3.

As indicated in phantom lines in FIG. 3, the nose of the diver projects along the lower wall 42 of the face mask body 12 with the tip of the nose positioned near the bottom of the triangular nose piece base 26. The diver's nostrils are positioned to be pinched by two pads 44 and 46 on the left and right sides of the nose piece base 26. The pads 44 and 46 as shown in FIGS. 3, 4 and 5, are essentially circular with the operative surfaces slightly convex.

The pads 44 and 46 are mounted for movement in generally arcuate paths centered about an axis *x* located adjacent the apex of the triangular nose piece base 26. The axis *x* is substantially perpendicular to the face plate and located well above the lower rim of the mask body. The axis *x* falls very close to the edge of the nasal bone where the nasal bone overlies cartilage at the top of the pyriform bone aperture.

Figure 2:
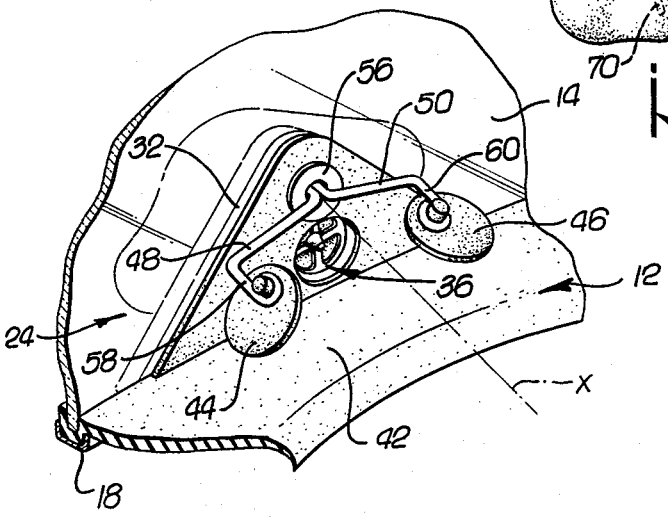
FIG. 2 is an enlarged fragmentary pictorial view showing the inside of the mask at the nose area.
Figure 5:
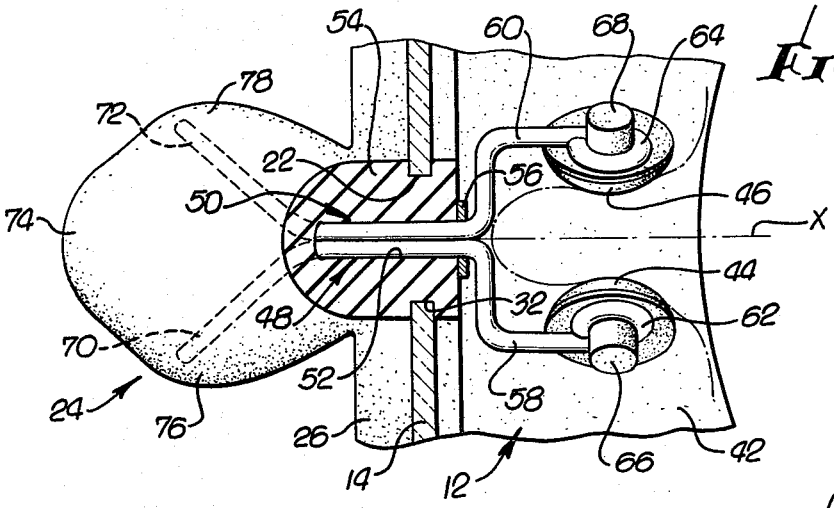
FIG. 5 is a fragmentary view similar to FIG. 4 but showing the nose pincer closed.

The arcs of movement of the pads are so designed that the pads 44 and 46 when moved downwardly, comfortably engage the convex portion of the fibroareolar tissue or nostril flaps, all as indicated in FIG. 5 and in phantom lines in FIG. 3. The pads 44 and 46 retract so as to avoid contact with the nostrils for ordinary mask operation, and as shown in FIGS. 1, 2 and 4.

Figure 6:
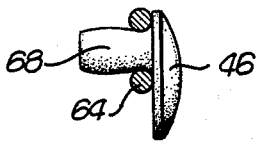
FIG. 6 is a sectional view taken along the line corresponding to line 6—6 of FIG. 3 and showing the eccentric mounting of one of the two nose pads.

In order to mount the pads 44 and 46 for angular movement about the central axis *x,* each pad is provided with a bent pivot rod or lever 48, 50. The pivot rods 48 and 50 each have central bearing portions that together project through a long small hole 52 (FIG. 4) extending through the apex region 54 of the nose piece base 26. A small washer 56 located about the inside edges of the hole 52 form bearings for the inner rod ends which are bent laterally to extend along the inside of the nose piece base 26. The inner rod ends have right angle projections 58 and 60 curled to form eyes 62 and 64 for receiving mounting stems 66 and 68 located on the rear portion of the pads. The stems 68 are snap fitted in the eyes and as shown most clearly in FIG. 6. The stems are eccentrically located. Hence by rotating the pads 44 and 46 about the stems 66 and 68, the pads can be moved to adjust to the diver's conformation.

The pads 46 and 48 are moved angularly to engaging position by the aid of handles 70 and 72. These handles are formed as bent outer ends of the pivot rods 48 and 50. The handles angle both outwardly and downwardly. The handles 70 and 72 are accessible just exteriorly of the mask at a place in line with the diver's nose. By squeezing the handles together, as with the thumb and forefinger, the device is operated. In order to conceal the handles and also to provide a means for retracting the pivot rods, the nose piece 24 has an outer bulbous nose-simulating protuberance 74. The protuberance 74 attaches only to the apex 54 of the nose base 26. From that place of attachment, the protuberance extends outwardly and downwardly as flaring nostrils 76 and 78. The handles 70 and 72 are embedded in the respective nostril portions of the protuberance.

In the retracted position of the pads 44 and 46, the ends or handles 70 and 72 diverge from the axis. The protuberance 74 is squeezed just as the human nostrils would be squeezed between the forefinger and thumb of the user. A pinching or squeezing of the protuberance causes the pivot rods to rotate and the pads 44 and 46 to engage the nostril flaps. With a quite natural and simple movement, the user accomplishes a closure of his nostrils so that he can equalize inner ear pressure by an exhaling or blowing effort. The movement is, except for a slight frontal displacement, exactly the same as if the diver pinched his own nostrils. This makes the purging operation virtually foolproof and so simple that divers, already required to perform complex technical routines, are thankful.

The resilience of the nose piece protuberance 74 serves to return the protuberance to its natural position, and correspondingly to retract the pads 44 and 46. The respective positions of the nose piece protuberance 74 are shown in FIGS. 4 and 5.

Figure 8:
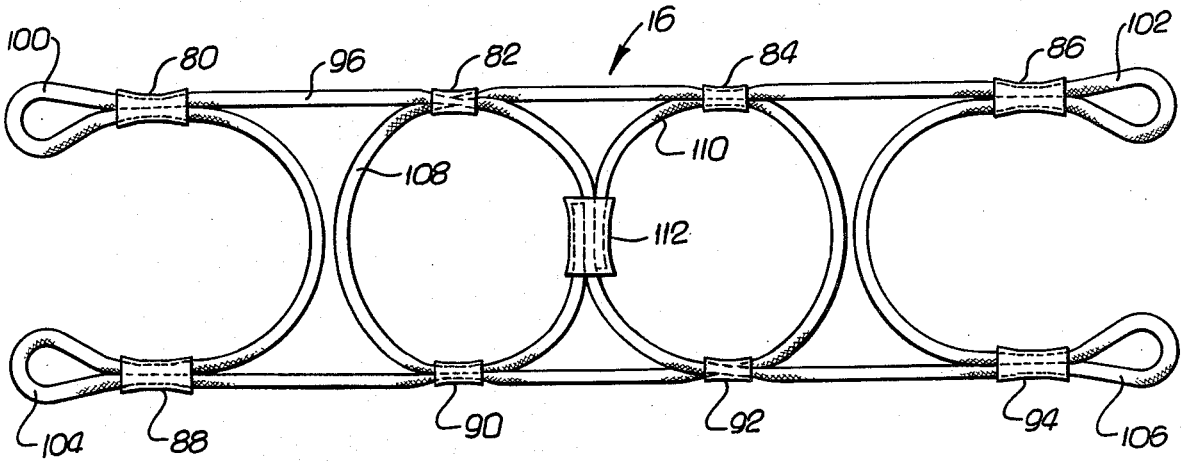
FIG. 8 is a developed view of the head strap apart from the mask itself.

The mask body 12 is stabilized upon the head of the diver by the strap 16 shown most clearly in FIG. 8. The strap 16 is made up of a single piece of highly elastic relatively small stretchable cord and a series of flared ferrules. The strap is defined at the top and bottom by top and bottom runs of cord. There are four top ferrules 80, 82, 84 and 86 spaced along the top run and four ferrules 88, 90, 92 and 94 on the bottom.

The elastic cord 96 has four corners each looped and extended through a corner ferrule 80, 86, 88 and 90 respectively in order to form eyes 100, 102, 104 and 106 by the aid of which the strap is attached. Between the corners and between the top and bottom runs of the elastic cord, circular loops 108 and 110 are formed in order to prevent undue separation of the runs and to provide a suitable cradle for head attachment. By the aid of the intermediate ferrules 82, 84, 90 and 92 as well as a ferrule 112 between the intermediate loops 108 and 110, a single continuous length of elastic cord forms the strap by suitably threading routine. Thus beginning at the central ferrule 112 which accommodates both ends, the cord can be traced as follows: clockwise through ferrules 84 and 92, along the lower run, through ferrule 90, through and returned through ferrule 88, through and returned through ferrule 80, along the upper run through ferrule 82, clockwise through central ferrule 112, counterclockwise through ferrule 92, along the bottom run, through and returned through ferrule 94, through and returned through ferrule 86, along the upper run, through ferrule 84 and 82, counterclockwise through ferrule 90 and counterclockwise back to the central ferrule 112. By drawing the cord through the corner ferrules, adjustment in strap length is accomplished. The intermediate ferrules 82, 84, 90, 92 and 112 may be crimped to preclude adjustment while the corner ferrules 80, 88, 102 and 106 must allow movement of the cord when the cord is elongated and reduced in thickness. When the cord is released, it locks up with the corner ferrules. Thus the ferrules are sufficiently small in diameter to hold the elastic cord in place by compression of the rubber core of the cord.

Figure 7:
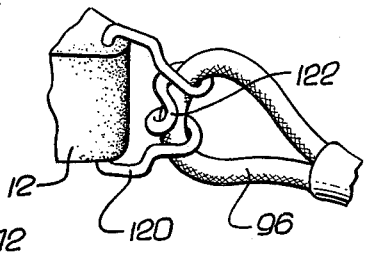
FIG. 7 is an enlarged fragmentary elevational view showing one of the four connectors between the head strap and the mask body.

The eyes are designed to be engaged by four identical metal buckles 120 (FIGS. 1 and 7), two at each side on lugs located at the rear of the mask. As shown in FIG. 7, the buckle 120 has pivot ends projecting to the lug to provide a generally vertical pivot for the buckles. The central bit portion of the buckle is convoluted about 360° so as to form a releasable catch for the eyelet. Thus the intermediate part of the convolution forms a seat for the eye, transmitting strap tension to the mask. Strap tension does not tend to unseat the strap because the strap eye to be released must be pushed in the reverse direction until it passes over the tip or point 122 of a convoluted bite portion. The bite portion forms, in effect, a hook for the strap eyes with the end of the hook returned partially over the hook seat.

The several features combine to achieve a mask comfortable not only in wearing, but also in use.

Intending to claim all novel, useful and unobvious features shown or described, I make the following claims:

1. In a mask for underwater divers:

(a) a mask including a face plate and a body having a flange adapted to fit the face of the wearer;

(b) a pair of pads adapted to engage the fibro-areolar tissue on opposite sides of the diver's nose;

(c) a pair of levers or pivot rods for the pads respectively;

(d) means mounting the pivot rods on the mask for angular movement about adjacent axes extending substantially perpendicular to the face plate and at about the area of the top of the pyriform nose bone aperture;

(e) said pivot rods having inner ends mounting said pads and having outer ends accessible frontally of the mask plate;

(f) the outer ends of said pivot rods forming normally downwardly diverging handles positioned to be squeezed between the thumb and forefinger of the user to cause angular movement of the pivot rods and movement of said pads from an upward retracted position to a downward tissue engaging position; and (g) means spring biasing said handles and said pads to retracted position.

2. The combination as set forth in claim 1 in which said spring biasing means comprises a nose simulating protuberance in which said outer pivot rod ends are enclosed, said protuberance being made of flexible material whereby digital pressure exerted on said protuberance transmits movement to said pivot rods.

3. The combination as set forth in claim 1 in which said face plate has an opening at the nasal area, a nose piece made of resilient material and having a base part fitted in said opening; said pivot rods extending through said nose piece base, said nose piece having an outer protuberance attached at the upper portion of said base, said protuberance enclosing the said outer ends of said pivot rod so that digital pressure exerted on said protuberance is transmitted to operate said pivot rods.

4. The combination as set forth in claim 3 in which said opening extends to the edge of said face plate, and together with a mask purge valve including a circular body fitted to an aperture in said nose piece base.

5. The combination as set forth in claim 1 in which the inner end of each of said pivot rods has means mounting its pads for angular movement about an axis substantially perpendicular to the pad surface but eccentrically thereof whereby the position of the pad relative to the fibro-areolar tissue may be adjusted to accommodate the conformation of different users.

6. In a mask for underwater divers:

(a) a mask including a face plate and a mask body of rubberlike material and having a flange adapted to fit the face of the wearer, said flange having a lower part adapted to fit between the nose and the upper lip of the wearer, said face plate having an opening at the nasal area, said mask body having a rim flange for receiving said face plate;

(b) a nose piece of resilient flexible material having a base part fitted in said opening of said face plate;

(c) a pair of pads adapted to engage the fibro-areolar tissue on opposite sides of the diver's nose;

(d) a pair of pivot rods for the pads respectively, each of the pivot rods having a central portion extending through said nose piece base at a place located substantially in line with the top of the pyriform nose bone aperture of the wearer, said nose piece base fitting said central portions of said pivot rods to support said pivot rods for angular movement;

(e) said pivot rods having inner ends mounting said pads at placed spaced from the axis of pivotal movement of said rods, said pivot rods having outer ends accessible frontally of the mask plate for digital engagement, the outer ends of said pivot rods downwardly diverging to provide handles positioned to be squeezed between the thumb and forefinger of the user to cause angular movement of the pivot rods and movement of said pads from an upward position to a downward tissue engaging position; and (f) said nose piece having an outer protuberance extending from and joined to the top of said nose piece base, said outer protuberance encasing said outer ends of said pivot rods, said outer nose piece protuberance being flexible and resilient to bias said pivot rods to retract said pads.

7. In a mask for underwater divers:

(a) a mask including a face plate and a mask body having a flange adapted to fit the face of the wearer;

(b) a head strap for said mask body, comprising a single elastic cord looped to provide widely spaced top and bottom generally parallel runs extending across the back of the mask body, said elastic cord also being looped to provide webbing between said top and bottom runs as well as to provide eyes at four corners of the head strap at the ends of said top and bottom runs;

(c) a series of ferrules through which said elastic cord extends and having restricted openings for yieldingly holding said elastic cord in a looped configuration, said cord being adjustable by movement through said ferrules to adjust the length of said strap as well as to adjust the width of the web between said top and bottom runs;

(d) four buckles each pivotally attached to said mask body, a pair at the left side and a pair at the right side, the buckles of each pair being widely spaced with one located substantially at the top portion of the mask body flange and one located substantially at the bottom portion of the mask body flange; and (e) each of the buckles having hook portions detachably connected to the respective eyes of said strap.

* * * * *